US005316084A

United States Patent [19]

Murray et al.

[11] Patent Number: 5,316,084

[45] Date of Patent: May 31, 1994

[54] WELL TOOL WITH SEALING MEANS

[75] Inventors: Douglas J. Murray, Humble; Robert J. Coon, Houston; Mark E. Hopmann, Alvin, all of Tex.; Ronald D. Williams, Morris, Okla.; Steve Jennings; Timothy R. Tips, both of Houston, Tex.

[73] Assignee: Baker Hughes Incorporated, Houston, Tex.

[21] Appl. No.: 751,350

[22] Filed: Aug. 28, 1991

Related U.S. Application Data

[63] Continuation-in-part of Ser. No. 573,581, Aug. 27, 1990, Pat. No. 5,156,220.

[51] Int. Cl.[5] ..... E21B 34/14

[52] U.S. Cl. ..... 166/332; 166/386; 166/387

[58] Field of Search ..... 166/373, 386, 332, 387

[56] References Cited

U.S. PATENT DOCUMENTS

| | | | |
|---|---|---|---|
| 3,051,243 | 12/1958 | Grimmer et al. | 166/332 |
| 3,071,193 | 6/1960 | Raulins | 166/332 |
| 3,395,758 | 5/1964 | Kelly et al. | 166/332 |
| 3,414,060 | 11/1967 | Zak | 166/332 |

*Primary Examiner*—Terry Lee Melius

*Attorney, Agent, or Firm*—Melvin A. Hunn; Mark W. Handley

[57] ABSTRACT

A downhole well tool is provided which includes a shifting sleeve for opening a flow communication port. The well tool includes first and second primary seal elements positioned upstream and downstream, respectively, of the port as well as upstream and downstream of the threaded connections between the well tool and sections of tubing forming the well flow conduit. A fluid diffuser element may be included to abate flow damage across the primary seal elements during the shifting of the sleeve. A method of selectively transmitting fluid incorporating said well tool also is disclosed.

48 Claims, 8 Drawing Sheets

WELL TOOL WITH SEALING MEANS

BACKGROUND OF THE INVENTION

Cross-Reference to Related Application

This application is a continuation-in-part of the earlier application Ser. No. 07/573,581, filed Aug. 27, 1990, entitled "Well Tool With Sealing Means now U.S. Pat. No. 5,156,220.

Field of the Invention

The invention relates to a subterranean well tool for use in oil and gas subterranean wells.

Description of the Prior Art

Subsequent to the drilling of an oil or gas well, it is completed by running into such well a string of casing which is cemented in place. Thereafter, the casing is perforated to permit the fluid hydrocarbons to flow into the interior of the casing and subsequently to the top of the well. Such produced hydrocarbons are transmitted from the production zone of the well through a production tubing or work string which is concentrically disposed relative to the casing.

In many well completion operations, it frequently occurs that it is desirable, either during the completion, production, or workover stages of the life of the well, to have fluid communication between the annular area between the interior of the casing and the exterior of the production tubing or workstring with the interior of such production tubing or workstring for purposes of, for example, injecting chemical inhibitor, stimulants, or the like, which are introduced from the top of the well through the production tubing or workstring and to such annular area. Alternatively, it may be desirable to provide such a fluid flow passageway between the tubing/casing annulus and the interior of the production tubing so that actual production fluids may flow from the annular area to the interior of the production tubing, thence to the top of the well. Likewise, it may be desirable to circulate weighting materials or fluids, or the like, down from the top of the well in the tubing/casing annulus, thence into the interior of the production tubing for circulation to the top of the well in a "reverse circulation" pattern.

In instances as above described, it is well known in the industry to provide a well tool having a port or ports therethrough which are selectively opened and closed by means of a "sliding" sleeve element positioned interiorly of the well tool. Such sleeve typically may be manipulated between open and closed positions by means of wireline, remedial coiled tubing, electric line, or any other well known auxiliary conduit and tool means.

Typically, such ported well tools will have upper and lower threaded ends, which, in order to assure sealing integrity, must contain some sort of elastomeric or metallic sealing element disposed in concert with the threads to prevent fluid communication across the male/female components making up the threaded section or joint. A placement of such a static seal represents a possible location of a seal failure and, as such, such failure could adversely effect the sealing integrity of the entire production tubing conduit.

Additionally, in such well tool, a series of upper and lower primary seals are placed in the housing for dynamic sealing engagement relative to the exterior of a sleeve which passes across the seals during opening and closing of the port element. As with all seals, such primary sealing means also represent an area of possible loss of sealing integrity. Thus, such prior art well tools have been commercially manufactured with four possible seal areas, the integrity of which can be compromised at any time during the well life and the usage of the tool.

During movement of the sleeve to open the port in such well tool to permit fluid communication between the interior and exterior thereof, such primary seals positioned between the interior wall of the well tool housing and the exterior wall of the shifting sleeve will first be exposed to a surge of fluid flow which can cause actual cutting of the primary seal elements as pressure is equalized before a full positive opening of the sleeve and, in some instances, during complete opening of the sleeve. In any event, any time such primary seals are exposed to flow surging, such primary seals being dynamic seals, a leak path could be formed through said primary seals.

Accordingly, the present invention provides a well tool wherein the leak paths as above described are reduced from four to two, thus greatly reducing the chances of loss of sealing integrity through the tool and the tubular conduit. Secondly, the well tool of the present invention also provides, in one form, a fluid diffuser seal element which resists flow cutting damage to the primary seal element by substantially blocking fluid flow thereacross during shifting of the sleeve element between open and closed positions.

Other objects and advantages of the incorporation of use of the present invention will be appreciated after consideration of the drawings and description which follow.

SUMMARY OF THE INVENTION

A downhole well tool is securable to tubular members for forming a section of the cylindrical fluid flow conduit within said well and for selective transmission of fluids therethrough between the interior and exterior of the tool.

The well tool comprises a housing. First and second threaded ends are provided for securing said housing between companion threaded ends of said tubular members. A fluid communication port is disposed through the housing and between the threaded ends. One of the threaded ends is positioned upstream of the port and the other threaded end is positioned downstream of the port. Primary sealing means are interiorly positioned around each of the tubular members and have a face in abutting relationship with the housing. One of the primary sealing means is positioned downstream of one of the threaded ends, and the other of the primary sealing means is positioned upstream of the other of the threaded ends.

The well tool also includes a sleeve which is disposed interiorly of the housing and is shiftable between first and second positions for selectively communicating and isolating the fluid communication port relative to the interior of the tool.

Each of the primary sealing means has an exterior face in circumferential sealing alignment with the housing and an interior face which is always in circumferential sealing alignment with the sleeve.

The apparatus also includes a flow diffuser ring element which is placed around the interior of the housing and downstream of the port to eliminate damage to the primary seal element downstream thereof such that there is effectively no flow across the primary seals during the shifting of the sleeve.

DETAILED DESCRIPTION OF THE INVENTION

Figure 1:
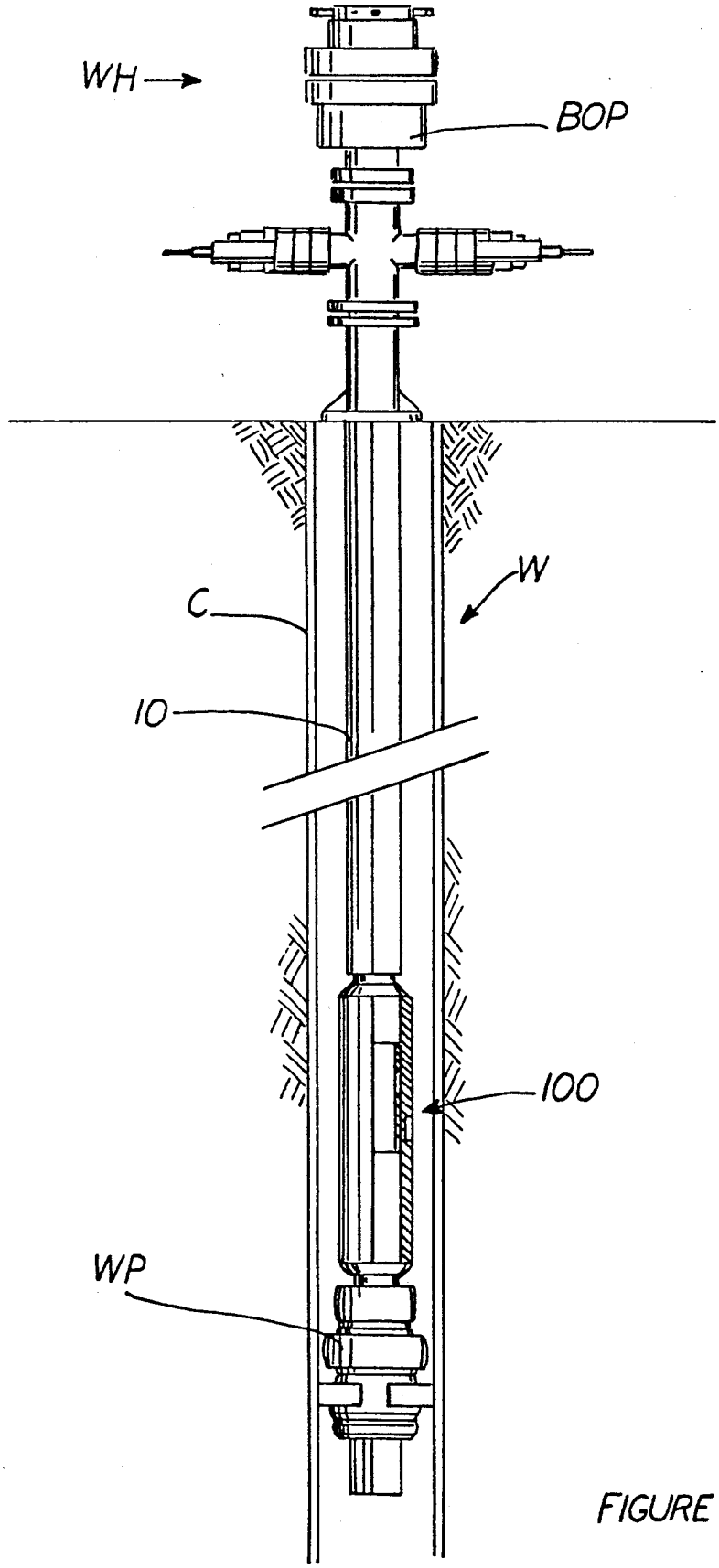
FIG. 1 is a longitudinal sectional view of a subterranean well showing the apparatus positioned above a well packer during actual production of the well.

With first reference to FIG. 1, there is schematically shown the apparatus of the present invention in a well W with a wellhead WH positioned at the top and a blowout preventor BOP positioned thereon.

It will be appreciated that the apparatus of the present invention may be incorporated on a production string during actual production of the well in which the wellhead WH will be in the position as shown. Alternatively, the apparatus of the present invention may also be included as a portion of a workstring during the completion or workover operation of the well, with the wellhead WH being removed and a workover or drilling assembly being positioned relative to the top of the well.

As shown in FIG. 1, the casing C extends from the top of the well to the bottom thereof with a cylindrical fluid flow conduit 10 being cylindrically disposed within the casing C and carrying at its lowermost end a well packer WP. The well tool 100 is shown being carried on the cylindrical fluid flow conduit 10 above the well packer WP.

Figure 2:
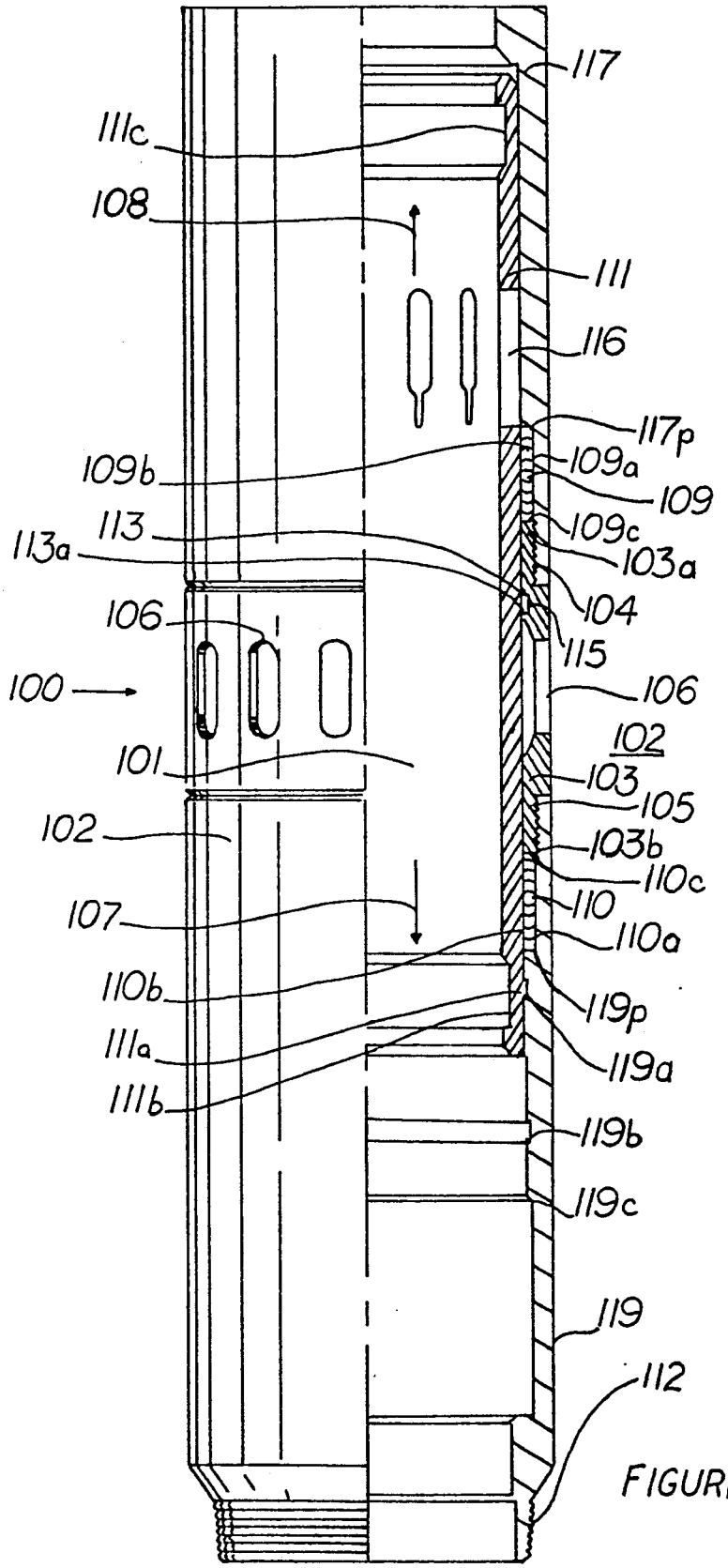
FIG. 2 is a longitudinally extending sectional view, partly interior and partly exterior, of the apparatus of the present invention with the port in fully closed position.

Now with reference to FIG. 2, the well tool 100 is secured at its uppermost end to a first tubular member 117 forming a portion of the cylindrical fluid flow conduit 10, and at its lowermost end to a second tubular member 119 forming the lowermost end of the cylindrical fluid flow conduit 10 and extending on to the well packer WP at threads 112. Alternatively, the well tool 100 of the invention may also be provided in a form wherein members 117, 119 are actual parts of the well tool itself, with members 117, 119 and 103 forming the entire outer housing.

The well tool 100 has a cylindrical interior 101 and an exterior 102 which are permitted to be selectively communicated therebetween by means of a fluid communication port 106.

In the position as shown in FIG. 1, it will be assumed that production fluids are to flow through the cylindrical fluid flow conduit 10 from below the well packer WP to the top of the well, but such flow could be in the opposite direction. Thus with reference to FIGS. 2, 3, and 4, the arrow 108 in the interior of the tool above the fluid communication port 106 is defined as pointing towards the downstream flow portion relative to the port 106 and the arrow 107 below the fluid communication port 106 is defined as pointing towards the upstream area of the fluid flow, as described.

The well tool 100 has a primary sealing means 109 downstream of a first threaded end 104. As shown, the sealing means 109 is comprised of a series of Chevron shaped thermoplastic compound elements, but may be in the form and include a number of well known sealing components for sliding sleeve mechanisms utilized in the well completion art.

With reference to FIG. 2, the sealing means 109 includes a lower face 109*c* which is in abutting engagement with the uppermost end 103*a* of the housing 103 which, in effect, is an abutting shoulder for receipt of the lower end of the sealing means 109.

An interior sealing face 109*b* of sealing means 109 projects interiorly of the inner wall of the first tubular member 117 for sealing dynamic contact with a cylindrical shifting sleeve 111 concentrically positioned within the well tool 100. Likewise, the sealing means 109 also has an outer face 109*a* facing exteriorly and away from the sleeve 111 for sealing engagement with the inner cylindrical wall of the first tubular member 117. The sealing means 109 is thus contained within a profile 117*p* of the first tubular member 117.

The sleeve 111 is normally secured in position for running into the well as shown in FIG. 2, where the fluid communication port 106 is closed. In some operations, for equalization purposes, and the like, the sleeve 111 may be placed in the "open" position such that the fluid communication port 106 is in fluid communication with the interior 101 of well tool 100 from the exterior 102 thereof. In any event, when the sleeve 111 is in the position where the fluid communication port 106 is in the "closed" position, an outwardly extending flexible latch element 111*a* is secured within an upper companion groove 119*a* on the tubular member 119. A shifting neck 111*b* is defined at the lowermost end of the sleeve 111 for receipt of a shifting prong (not shown) of a wireline, coiled tubing, or the like, shifting tool for manipulating the sleeve 111 from one position to another position relative to the fluid communication port 106. As the shifting prong engages the shifting neck 111*b*, a downward load may be applied across the shifting prong through the shifting neck 111*b* to the sleeve 111 to move same, such as from the fully "closed" position shown in FIG. 2, to the intermediate equalizing position shown in FIG. 3, or the fully open position shown in FIG. 4. Once sleeve 111 is shifted, the latch 111*a* will rest in snapped engagement in intermediate groove 119*b* downstream of groove 119*c* and, in such position, the sleeve 111 is in the equalized position. Continued downward movement will move the sleeve 111 to the fully open position, and the latch 111*a* will be in the groove 119*c*. Of course, the sleeve 111 may also be moved by appropriate connection of a shifting tool at an alternate shifting neck 111*c* at the top end of the sleeve 111.

Figure 9:
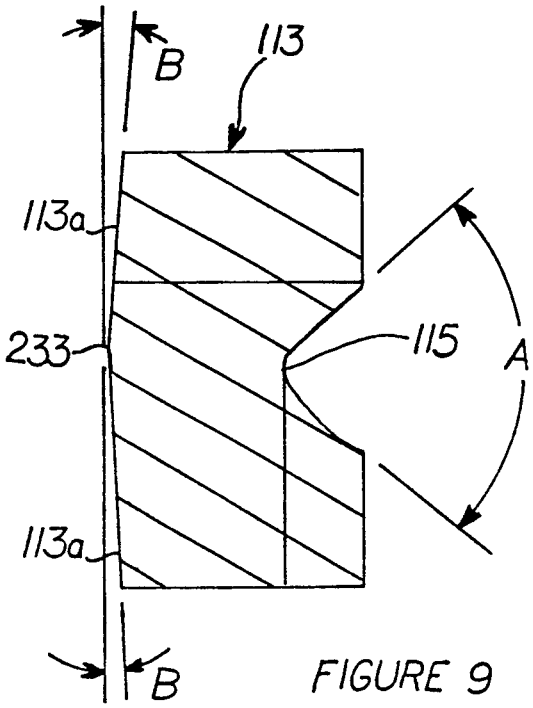
FIG. 9 is an enlarged view of the preferred diffuser element of the wellbore tool of the present invention.

With reference to FIG. 9, fluid flow diffuser ring 113 has an outwardly defined angled expansion area 115, with an angle A equal to 45 degrees, around the exterior to permit the components of fluid flow diffuser 113 to expand therein as the well tool 100 encounters increased temperatures and pressures within the well W, during operations. An inner wall 113*a* of fluid flow diffuser ring 113 will sealingly engage along the exterior surface of the sleeve 111 such that there is substantially no fluid flow across the primary sealing means 109 as the sleeve 111 is shifted to open the fluid communication port 106 relative to the interior 101 of the tool 100. Inner wall 113*a* is formed of two surfaces at an angle B, equal to 5 degrees, from the exterior surface of sleeve 111, which contact the exterior surface of sleeve 111 at a diffuser contact point 233.

Fluid flow diffuser 113 may be made of any substantially hard nonelastomeric but plastic material such as Polyetheretherkeytone (PEEK), manufactured and available from Green, Tweed & Company, Kulpsville, Pa. It will be appreciated that the fluid flow diffuser ring 113 is not a conventional elastomeric seal which degrades rapidly during shifting or other "wiper" which only serves the function of wiping solid or other particulate debris from around the outer exterior of the sleeve 111 as it dynamically passes across the sealing means 109 but, rather, fluid flow diffuser 113 acts to substantially eliminate fluid flow to prevent fluid flow damage to the primary sealing assembly, 109.

Below the fluid communication port 106 and positioned at the lowermost end of the housing 103 in upstream direction 107 from second threaded end 105 is a second sealing means 110 emplaced within a profile 119*p* of tubular member 119. This sealing means 110 may be of like construction and geometrical configuration as the sealing means 109, or may be varied, to accommodate particular environmental conditions and operational techniques.

With reference to FIG. 2, sealing means 110 has an upper face 110*c* which abutts lowermost end 103*b* of housing 103 below second threaded end 105 of housing 103. The outer face of the seals 110*a* is in sealing smooth engagement with the inner wall of the profile 119*p* of second tubular member 119. Additionally, the interior face 110*b* of sealing means 110 faces inwardly for dynamic sealing engagement with the sleeve 111 positioned thereacross. An upper face 110*c* of the sealing means 110 contacts the lowermost end 103*b* of housing 103.

OPERATION

The well tool 100 is assembled into the cylindrical fluid flow conduit 10 for movement within the casing C by first securing the housing to the first and second tubular members 117, 119 at their respective threaded ends 104, 105. The sleeve 111 will be concentrically housed within the well tool 100 at that time with the sealing means 109, 110 in position as shown in, for example, FIG. 2.

During makeup, the seal means 109, 110, will, of course, be secured within their respective profiles 117*p* and 119*p*. Now, the first tubular member 117 and/or the second tubular member 119 are run into the well W by extension thereto into a cylindrical fluid flow conduit 10 with, in some instances, the well packer WP being secured at the lowermost end of the second tubular member 119 at, for example, threads 112. If the well tool 100 is run into the well in the closed position, the well tool 100 will be in the position as shown in FIGS. 1 and 2.

Figure 3:
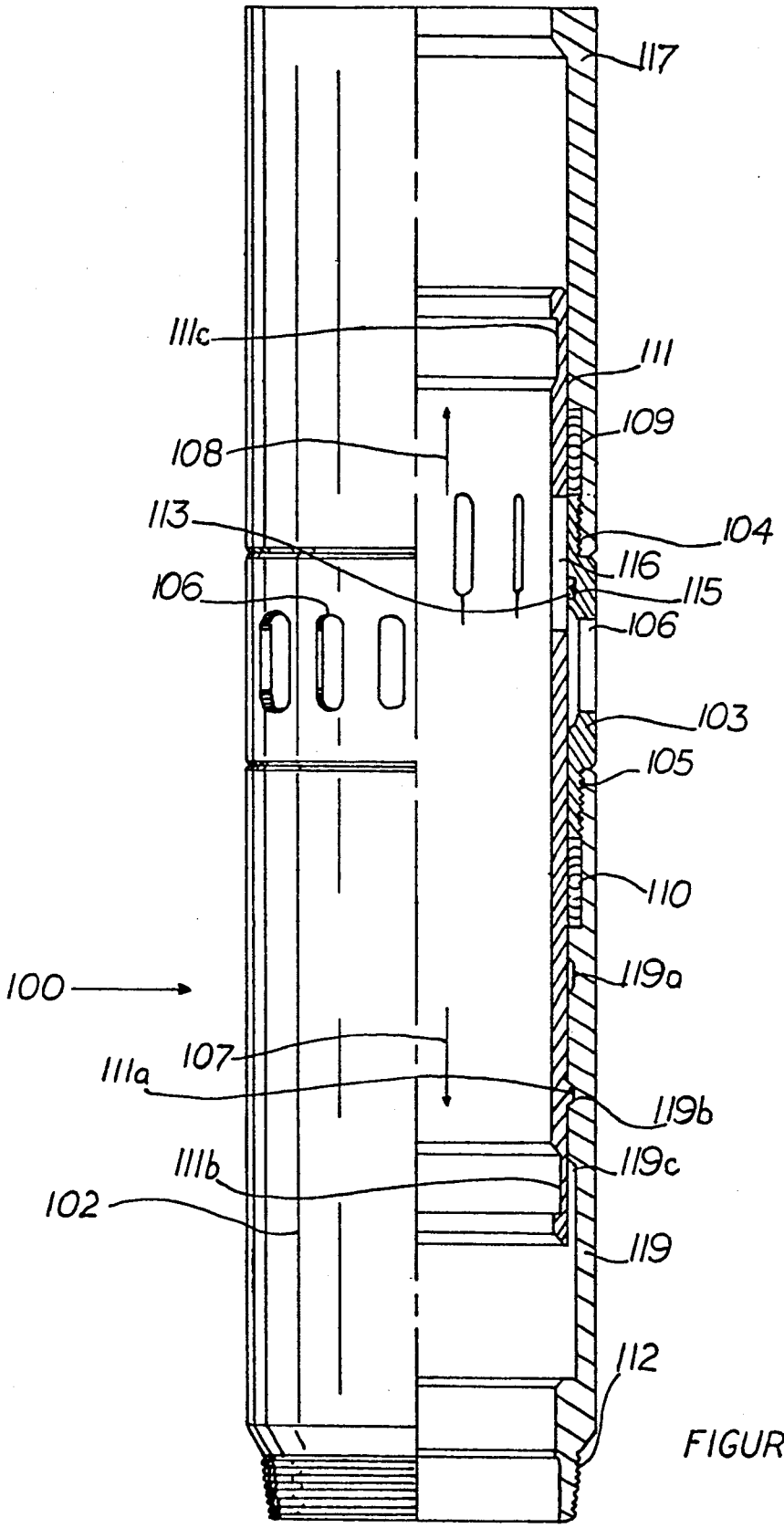
FIG. 3 is a view similar to FIG. 2 showing the apparatus with the sleeve and port in intermediate, or equalizing, position.

When it is desired to open the fluid communication port 106, the sleeve 111 is manipulated from the position shown in FIG. 2 to the position shown in FIG. 3, where pressure exterior of the well tool 100 and interior thereof are first equalized. It will be appreciated that the positioning and location of the sealing means 109, 110 relative to their respective threaded ends 104, 105, eliminate the necessity of a fluid tight seal being required between these threaded members, thus greatly reducing by a factor of 50 percent the number of locations for possible loss of pressure integrity within the well tool 100.

Additionally, it will also be appreciated that such positioning of the primary seal 109 in a position in downstream direction 108 relative to the fluid flow diffuser 113 prevents such seals from being exposed to fluid flow when the sleeve 111 is shifted from the position shown in FIG. 2, where the fluid communication port 106 is isolated from the interior 101 of the tool 100, to the equalizing position, shown in FIG. 3.

Figure 4:
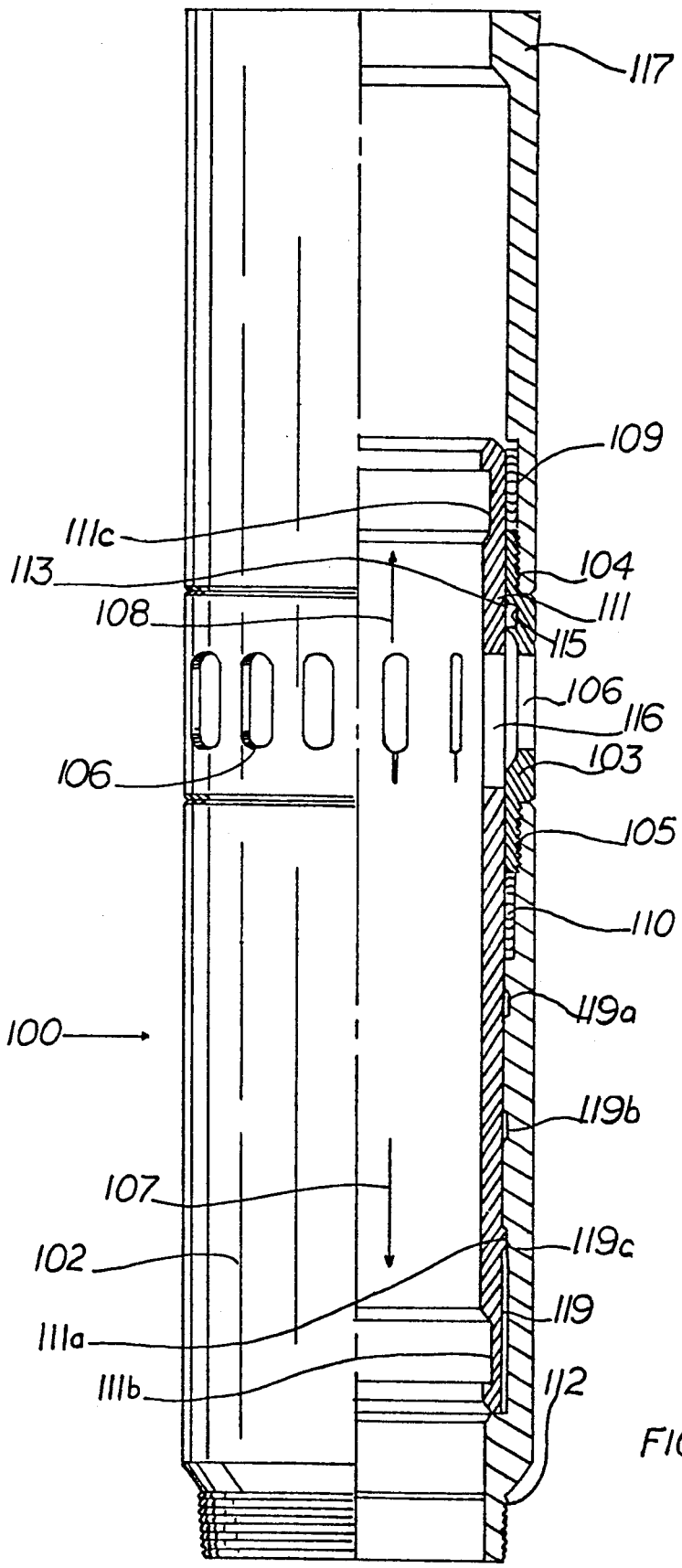
FIG. 4 is a view similar to that of FIGS. 2 and 3 showing the port of the well tool of the present invention in an open condition.

Subsequent to the shifting of the sleeve 111 to the equalized position, it may be opened fully to the position shown in FIG. 4. Where equalization is not deemed to be a particular problem because of comparative low pressure environments of operation, the tool may, of course, be shifted from the position shown in FIG. 2 to the position shown in FIG. 4, without any sort of time in the equalization position shown in FIG. 3.

ADDITIONAL DETAILED DESCRIPTION

Figure 5:
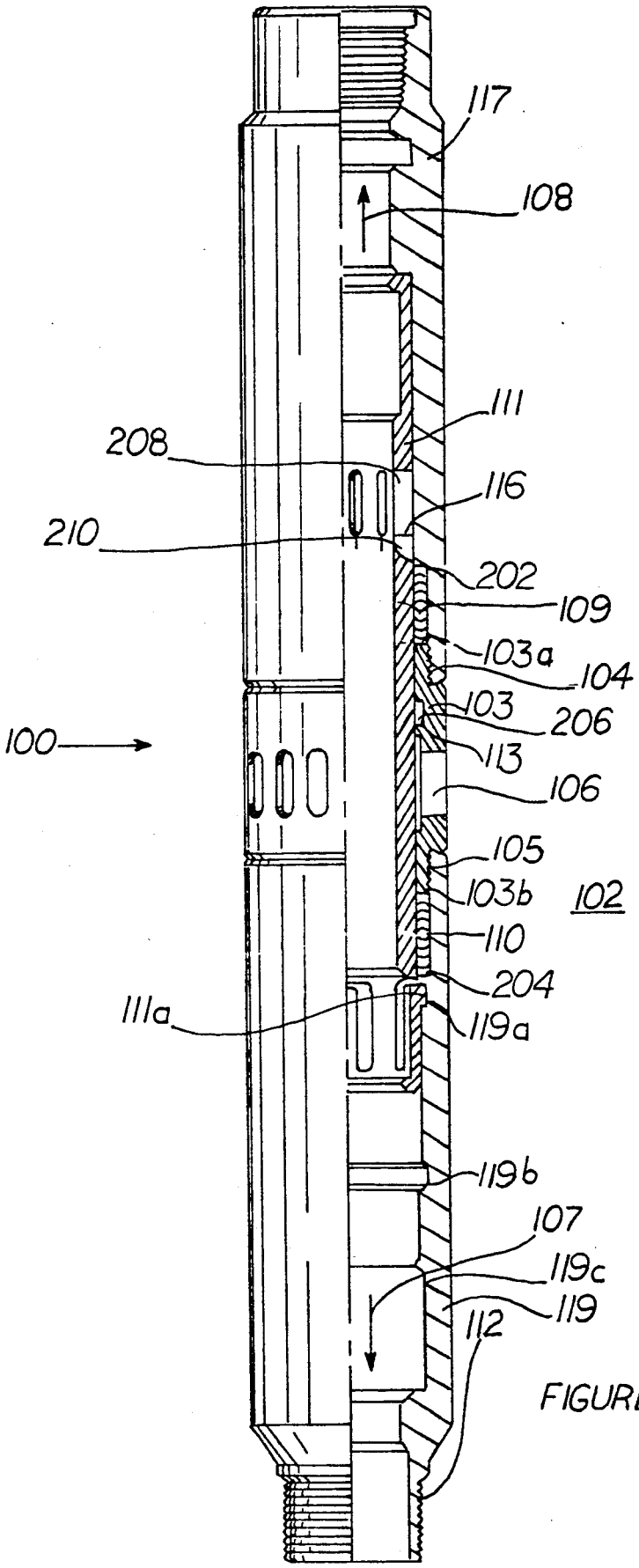
FIG. 5 is a longitudinally extending quarter sectional view of the wellbore tool of the present invention shown in a closed position.
Figure 10:
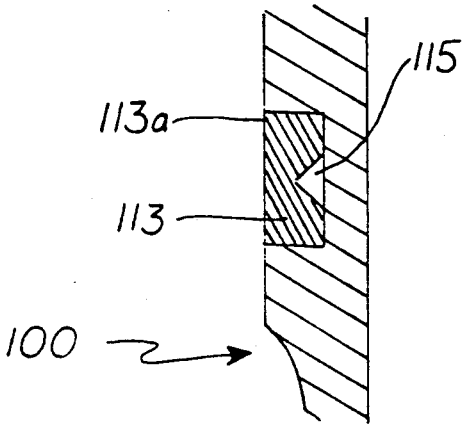

FIG. 5 is a one-quarter longitudinal section view of the preferred wellbore tool 100 of the present invention, shown in a closed position. In this position, fluid in exterior region 102 is prevented from passing into wellbore tool 100 through communication port 106, by the position of sleeve 111. As shown in FIG. 5, a number of components cooperate to form the preferred wellbore tool 100 of the present invention. These components include upper sub 117, lower sub 119, sleeve 111, and housing 103, and upper and lower seal means 109, 110. A fluid flow diffuser element 113 is also provided. As shown, the upper and lower seal cavities 202, 204 are provided in a region formed between upper and lower subs 117, 119, and sleeve 111. Upper seal cavity 202 is bounded at its lower end by upper end 103*a* of housing 103. Lower seal cavity 204 is bounded at its upper end by the lower end 103*b* of housing 103. Communication port 106 is centrally disposed on housing 103, and is in fluid communication with exterior 102 of wellbore tool 100. Fluid in the annular region between wellbore tool 100 and the wellbore wall, or casing, will be allowed to flow inward of wellbore tool 100 when sleeve 111 is moved from the closed position of FIG. 5 to the open position of FIG. 7. In the equalized position of FIG. 6, sleeve 111 is in an intermediate position, which allows a very limited amount of fluid to flow from exterior 102 to Wellbore tool 100 to equalize the pressure differential therebetween.

Returning now to FIG. 5, housing 103 is further equipped with diffuser cavity 206, which is adapted to receive diffuser 113. Diffuser 113 is provided between communication port 106, and upper seal means 109, and serves to diminish the force impact of high pressure fluid from exterior 102 to prevent damage to upper seal means 109. As shown in FIG. 5, diffuser 113 is positioned upward from communication port 106, and is especially suited for diminishing the force impact of high pressure fluid when fluid is flowing upward within wellbore tool 100 in the direction of downstream flow arrow 108.

As shown in FIG. 5, sleeve 111 is provided in close proximity to upper and lower subs 117, 119, and is in facial and sliding interface with upper and lower sealing means 109, 110 and includes fluid slots 208, having selected ones which terminate at the lower end at equalization inlets 210, which have a diminished fluid flow capacity in comparison to fluid slot 208. Fluid slots 208 and equalization inlets 210 together define fluid flow ports 116 through sleeve 111. FIG. 5 depicts one fluid slot 208 in partial longitudinal section, which terminates at its lower end at equalization inlet 210. Fluid flow from exterior 102 through communication port 106 is allowed when either equalization inlet 210 of fluid slot 208 is aligned with communication port 106. In the preferred embodiment, a plurality of communication ports 106 are provided circumferentially around housing 103, each communicating with a selected fluid slot 208, or fluid slot 208 with equalization inlet 210, which are circumferentially disposed about sleeve 111.

Figure 6:
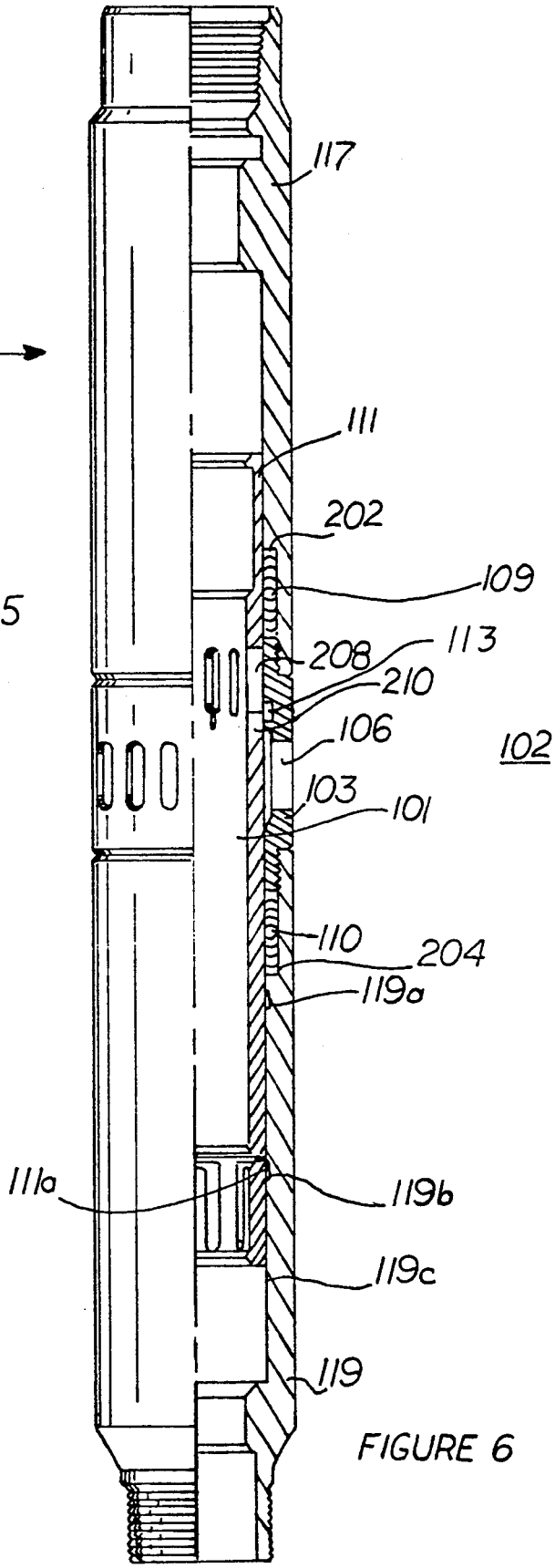
FIG. 6 is a longitudinally extending quarter sectional view of the wellbore tool of the present invention shown in an intermediate equalizing position.
Figure 7:
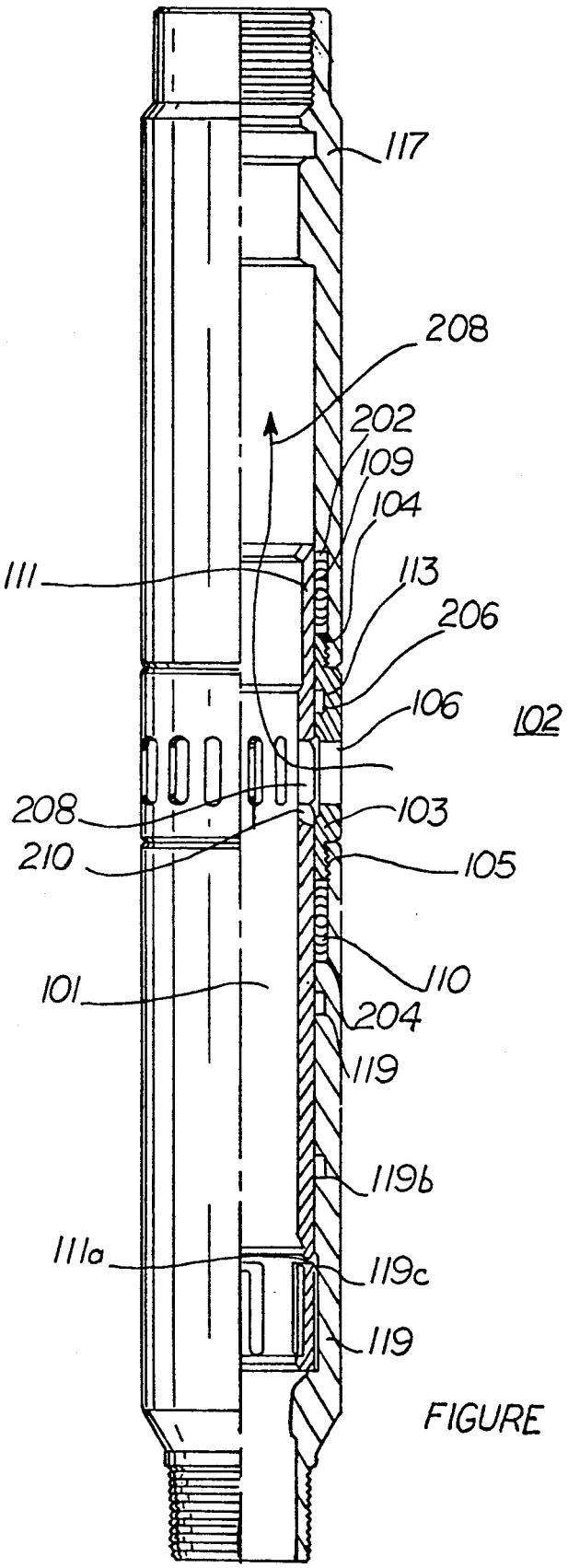
FIG. 7 is a longitudinally extending quarter sectional view of the wellbore tool of the present invention shown in an open position to allow fluid communication between the exterior and interior of the wellbore tool.

Several important features of the present invention are graphically depicted in FIGS. 5, 6, and 7.

First, it is important to note that threaded ends 104 and 105 which serve to couple housing 103 to upper and lower subs 117, 119 are disposed between upper and lower sealing means 109, 110, along with communication port 106. Therefore, the interface of upper sub 117, and housing 103 need not be sealed with O-ring seals, or other seal elements, as is conventional in the prior art. In addition, the coupling of housing 103 and lower sub 119 likewise need not be provided with seals such as O-ring seals, or other conventional seals, as is conventional in the prior art. This elimination of the need for seals at the junction of upper sub 117 and housing 103, and lower sub 119 and housing 103, eliminates the requirement for additional seals, and reduces the total number of sealing elements required for the wellbore tool 100 of the present invention. This is a significant advantage over the prior art devices, since each seal element poses an additional risk of failure, especially over the course of time as the materials which comprise elastomeric seal elements eventually deteriorate.

In the wellbore tool 100 of the present invention, as shown in FIG. 5, upper and lower seal means 109, 110 are provided in upper and lower seal cavities 202, 204, and provide a seal against the passage of fluid upward or downward along the interface of upper and lower subs 117, 119 and sleeve 111. In the preferred embodiment of the present invention, upper and lower sealing means 109, 110 preferably do not include elastomeric elements which will degrade over time.

FIG. 6 shows the wellbore tool of the present invention in an equalized position, with equalization inlet 210 in fluid communication with communication port 106, for receiving fluid from exterior 102 for passage into interior 101. In the preferred embodiment, equalization inlet 210 provides a restricted flow path, which allows for gradual diminishment of the pressure differential between interior 101 and exterior 102. Fluid which is directed from exterior 102 is passed across diffuser element 113, which limits the rate of flow from exterior 102 to interior 101.

A second important feature of the wellbore tool 100 of the present invention is that during the equalization mode of operation, upper and lower sealing means 109, 110 are maintained in a protected position, completely enclosed within upper and lower seal cavities 202, 204. Diffuser element 113 alone is exposed to the high forces of fluid during the equalization mode of operation. In the equalization mode of operation, fluid slot 208 has traveled downward relative to upper seal cavity 202, so that no portion of fluid slot 208 is aligned with upper sealing means 109. Instead, sealing means 109 is contained entirely within upper seal cavity 202, with upper sub 117 on one side, and sleeve 111 on the opposite side. Thus, during the equalization mode of operation, as depicted in FIG. 6, upper seal means 109 is not exposed to substantial fluid flow from either interior 101 or exterior 102, and is certainly not exposed to any appreciable flow of high pressure fluids. Subjecting upper seal means 109 to high pressure fluid flow during the equalization mode of operation could result in damage to upper seal means 109. Thus, in the present invention, it is extremely important that no portion of upper seal means 109 be exposed to substantial high pressure wellbore fluid flow during the equalization mode of operation.

In the preferred embodiment of the present invention, diffuser 113 is exposed to substantial wellbore fluid flow potential only during the equalization mode of operation. This is revealed by comparison of FIGS. 6 and 7 which depict respectively the equalization position and open position. As shown in FIG. 7, diffuser 113 is maintained in diffuser cavity 206 during the flowing mode of operation. Diffuser 113 is somewhat protected from the flow of fluid by sleeve 111 which is in abutment and disposed radially inward from diffuser element 113. As shown in FIG. 7, during a flowing mode of operation, communication port 106 is in alignment with fluid slot 208, allowing the fluid to flow from exterior 102 to interior 101 in the direction of arrow 208.

If leak paths develop at threaded ends 104, 105, the performance of wellbore tool 100 will not be diminished, since fluid may flow downward along the interface of sleeve 111 and housing 103 only to seals 109 or 110, respectively.

Figure 8:
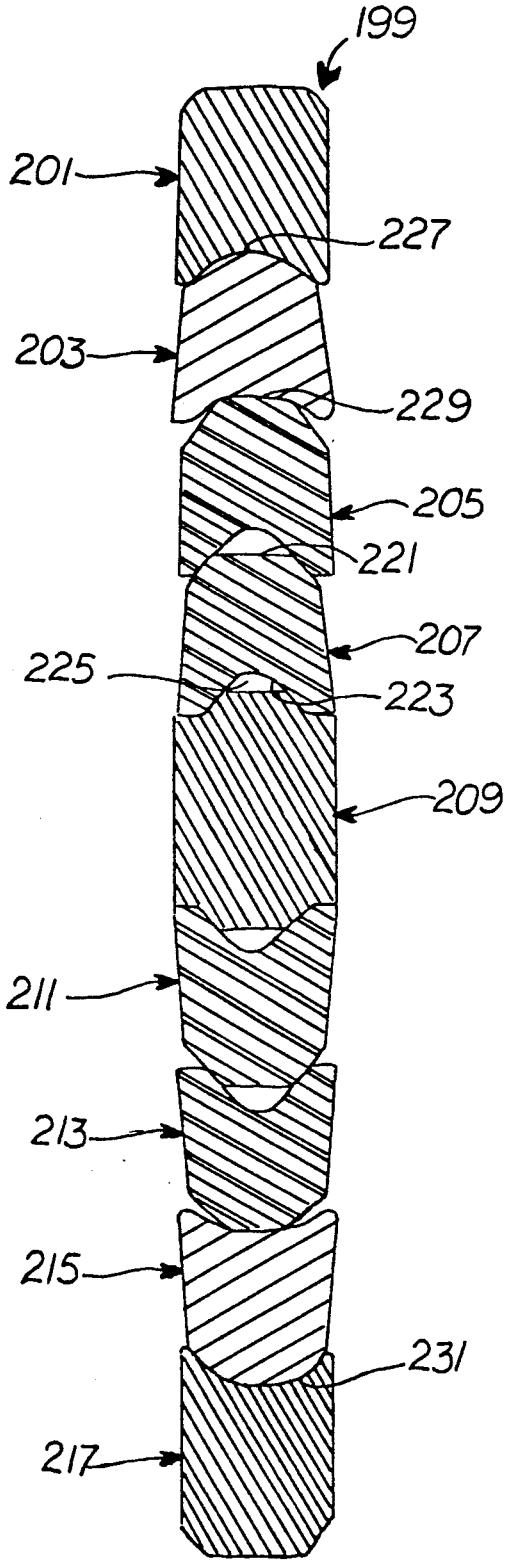
FIG. 8 is an enlarged view of a packing stack 199 of the wellbore tool of the present invention.

FIG. 8 is an enlarged view of a prior art packing stack 199 which is used in the present invention. Packing stack 199 comprises the seal element which is disposed in upper and lower sealing means 109, 110. Packing stack 199 includes a number of components which cooperate together to form a fluid-tight seal when disposed in either upper or lower seal cavities 202, 204, between upper and lower subs 117, 119, and sleeve 111. As shown, packing stack 199 is equipped with the center adapter 209, and end adapters 201, 217, all of which are formed of metal. These elements essentially serve as spacers and to prevent the flow of Chevron-shaped seals 205, 207, 211, 213 which are formed of a thermoplastic material, such as polytetrafluoroethylene, commonly referred to under the Du-Pont trademark as TEFLON. These elements do not perform any sealing function either. It is important to keep in mind that center and end adapters 209, 201, 217 are circular in shape. FIG. 8 is merely a sectional view of these ring-like elements.

Three sealing elements are disposed between center adapter 209 and end adapter 201. Likewise, three sealing elements are provided disposed between center adapter 209 and end adapter 217. One set of sealing elements are disposed upward from center adapter 209, and the other set of sealing elements are disposed downward in position from center adapter 209. Since packing stack 199 is symmetrical about center adapter 209, the upward and downward directions have not been indicated in FIG. 8. It is also important to keep in mind that packing stack 199 of FIG. 8 is snugly disposed in either upper or lower seal cavities 202, 204. The sealing elements disposed above and below center adapter 209 are subjected to axial compressive force which flares the sealing elements radially outward slightly to engage on one side either upper or lower sub 117, 119, and to engage on the other side sleeve 111. Engagement between the sealing elements and upper sub 117, lower sub 119, and sleeve 111 is a sealing engagement, which can withstand significant pressure differentials, and maintain a tight seal.

As shown in FIG. 8, Chevron seals 205, 207 are disposed on one side of center adapter 209. Chevron seals 211, 213 are disposed on the opposite side of center adapter 209. Each Chevron seal 205, 207, 211, 213 is equipped with one male end 221, and one female end 223. Each female end 223 is equipped with a central cavity which is adapted for receiving other male ends of the sealing and adapter rings of packing stack 199.

In the preferred embodiment, Chevron seals 205, 207, 211, 213 are flared slightly outward at female ends 223, and are maintained in a protected position, completely enclosed within upper and lower seal cavities 202, 204. Diffuser element 113 alone is exposed to the force impact of high pressure fluid flow during the equalization mode of operation.

In the equalization mode of operation, fluid slot 208 has traveled downward relative to upper seal cavity 202, so that no portion of fluid slot 208 is aligned with upper sealing means 109. Instead, sealing means 109 is contained entirely within upper seal cavity 202, with upper sub 117 on one side, and sleeve 111 on the opposite side. Thus, during the equalization mode of operation, as depicted in FIG. 6, upper seal means 109 is not exposed to fluid from either interior 101 or exterior 102, and is certainly not exposed to any flow of high pressure fluids. Subjecting upper seal means 109 to substantial high pressure fluid flow during the equalization mode of operation could result in damage to upper seal means 109. Thus, in the present invention, it is extremely important that no portion of upper seal means 109 be exposed to substantial high pressure wellbore fluid flow during the equalization mode of operation.

In the preferred embodiment of the present invention, diffuser 113 is placed in the flow path of wellbore fluids only during the equalization mode of operation. This is revealed by comparison of FIGS. 6 and 7 which depict respectively the equalization position and open position. As shown in FIG. 7, diffuser 113 is maintained in diffuser cavity 206 during the flowing mode of operation, which is depicted in FIG. 7, and substantially shielded from the fluid flow path. Diffuser 113 is somewhat protected from the flow of fluid by sleeve 111 which is in abutment and disposed radially inward from diffuser element 113. As shown in FIG. 7, during a flowing mode of operation, communication port 106 is in alignment with fluid slot 208, allowing the fluid to flow from exterior 102 to interior 101 in the direction of arrow 208.

If leak paths develop at threaded ends 104 or 105, the performance of wellbore tool 100 will not be diminished, since fluid may flow downward along the interface of sleeve 111 and housing 103 only to seals 109 or 110, respectively.

Although the invention has been described in terms of specified embodiments which are set forth in detail, it should be understood that this is by illustration only and that the invention is not necessarily limited thereto, since alternative embodiments and operating techniques will become apparent to those skilled in the art in view of this disclosure. Accordingly, modifications are contemplated which can be made without departing from the spirit of the described invention.

What is claimed is:

1. A downhole well tool securable to tubular members for forming a section of fluid flow conduit when said well for selective transmission of fluids therethrough between an interior and an exterior of said tool, said tool comprising:

a housing;

first and second threaded ends for securing said housing between companion ends of said tubular members;

at least one fluid communication port disposed through said housing and between said threaded ends;

a sleeve which is selectively movable for selectively obstructing said at least one fluid communication port to prevent said selective transmission of fluids therethrough;

sealing means interiorly positioned around and sealingly engaging between said tubular members and said sleeve;

said sleeve having at least one fluid flow port disposed through said sleeve which is selectively moveable between at least two positions, said at least two positions including:

a closed position, wherein said at least one fluid flow port is positioned radially inward of a selected one of said tubular members and at least a portion of said sealing means is positioned between said at least one fluid flow port and said at least one fluid communication port; and an open position, wherein said at least one fluid flow port is positioned radially inward of said housing to allow said selective transmission of fluids between said at least one fluid flow port and said at least one fluid communication port.

2. A downhole well tool securable to tubular members for forming a section of fluid flow conduit within said well for selective transmission of fluids therethrough between an interior and an exterior of said tool, said tool comprising:

a housing which has at least one fluid communication port disposed therethrough;

first and second threaded ends for securing said housing between companion ends of said tubular members;

a sleeve disposed within said housing;

first and second seal members positioned about and sealingly engaging between said sleeve and said tubular members to prevent a fluid flow of gases and liquids therebetween across said sealing means;

wherein said sleeve has at least one fluid flow port disposed therethrough and wherein said sleeve is selectively moveable between at least two positions, including:

a closed position, wherein said first seal member is disposed between and sealingly between said at least one fluid flow port and said at least one fluid communication port;

an open position, wherein said first and second seal members are disposed removed from a fluid flow path between said at least one fluid flow port and said at least one fluid communication port for said selective transmission of fluids between said at least one fluid flow port and said at least one fluid communication port;

a fluid flow diffuser disposed between said at least one fluid communication port and said at least one fluid flow port when said first seal member is positioned between said at least one fluid flow port and said at least one fluid communication port; and wherein said fluid flow diffuser chokes a flow of fluids between said at least one fluid flow port and said at least one fluid communication port to substantially reduce said flow of fluids across said first seal means when said sleeve is selectively moved between said closed position and said open position.

3. A downhole well tool securable to tubular members for forming a section of cylindrical fluid flow conduit within a well for selective transmission of fluids therethrough between an interior and an exterior of said tool, said tool comprising:

a housing which has at least one fluid communication port disposed through said housing;

a sleeve disposed about said housing;

a sealing means positioned about said housing and said sleeve, and sealingly engaging between said housing and said sleeve to prevent a fluid flow of gases and liquids therebetween across said sealing means;

wherein said sleeve has at least one fluid flow port disposed therethrough which is selectively moveable between at least two positions, including:

a closed position, wherein at least a portion of said sealing means is disposed between and sealing between said at least one fluid flow port and said at least one fluid communication port, and said at least one fluid flow port is isolated from fluid communication with said at least one fluid communication port to prevent fluid flow therethrough;

an open position, wherein said sealing means is disposed removed from a fluid flow path between said at least one fluid flow port and said at least one fluid communication port, and said at least one fluid flow port is in fluid communication with said at least one fluid communication port so that fluid may flow between said at least one fluid flow port and said at least one fluid communication port for said selective transmission of fluids;

a fluid flow diffuser disposed between said sleeve and said housing, and which, when said sleeve is in said closed position, is disposed between said at least one fluid communication port and said at least one fluid flow port for protecting said sealing means; and wherein said fluid flow diffuser chokes a flow of fluids between said at least one fluid flow port and said at least one fluid communication port to substantially reduce said flow of fluids across said fluid flow diffuser when said sleeve is selectively moved between said closed position and said open position.

4. The downhole well tool of claim 3:

wherein said housing includes a separating distance between said sealing means and said fluid flow diffuser, said separating distance having a length which is longer than an overall length of said at least one fluid communication port; and wherein said separating distance is larger than said overall length to dispose said sealing means in a substantially enclosed region, which is formed in part by said sleeve, by said at least one fluid flow port not extending between both said fluid flow diffuser and said sealing means when said sleeve is in any of said at least two positions, and any intermediate position therebetween.

5. A downhole well tool for use as a valve in a section of fluid flow conduit in a wellbore for a selective transmission of fluids therethrough, said downhole well tool comprising:

a stationary member, which has at least one fluid communication port disposed therethrough;

a movable valve member, which is selectively movable relative to said stationary member between at least two positions for said selective transmission of fluids, said at least two positions, including:

a closed position, wherein said selective transmission of fluids is prevented;

an open position, wherein said selective transmission of fluids is permitted;

a sealing means which, at least when said movable valve member is in said closed position, is at least in part disposed between said housing and said moveable valve member to prevent said transmission of fluid therethrough;

a fluid flow diffuser having a diffuser body which is disposed between said sealing means and said fluid communication port when said movable valve member is in an intermediate position between said closed position and said open position;

a mating surface disposed adjacent to said fluid flow diffuser when said moveable member is in said intermediate position, said mating surface being moveable relative to said fluid flow diffuser when said moveable member is selectively moved;

wherein at least a portion of said selective transmission of fluids occurs between said fluid flow diffuser and said mating surface when said movable valve member is in said intermediate position; and wherein said at least a portion of said selective transmission of fluids is choked to a substantially reduced fluid flow rate, which is reduced substantially lower than a fluid flow rate which is not choked, by flowing between said fluid flow diffuser and said mating surface, and thus protecting said sealing means from damage by only passing said substantially reduced flow rate by said sealing means.

6. The downhole well tool of claim 5:

wherein said selective transmission of fluids is between an interior and an exterior of said stationary member;

wherein said stationary member is a housing, said moveable valve member is a sleeve disposed concentrically within said housing, and said sleeve is movable with respect to said housing in a continuum of positions between said open position and said closed position, said continuum of positions including at least one said intermediate position which is an equalization position; and wherein said fluid flow diffuser is a separate member disposed within a groove within said housing between said housing and said moveable valve member, and said mating surface is included as a surface of said moveable member.

7. The downhole well tool of claim 5, wherein said fluid flow diffuser includes a diffuser contact surface which presses against said mating surface to choke said at least a portion of said selective transmission of fluids to provide said substantially reduced fluid flow rate.

8. The downhole well tool of claim 5:

wherein said fluid flow diffuser includes a diffuser contact surface which presses against said mating surface to choke said at least a portion of said selective transmission of fluids to provide said substantially reduced fluid flow rate;

wherein said diffuser contact surface is a portion of at least one diffuser peripheral surface and contacts said mating surface, and said diffuser contact surface defines a contact surface area which is smaller than a peripheral surface area of said at least one diffuser peripheral surface; and wherein a reduced frictional engagement, which is reduced in comparison to a full frictional engagement, is provided between said mating surface and said fluid flow diffuser by said diffuser contact surface defining a contact surface area which is smaller than a peripheral surface area of said at least one diffuser peripheral surface.

9. The downhole well tool of claim 5:

wherein said fluid flow diffuser includes a diffuser contact surface which presses against said mating surface to choke said at least a portion of said selective transmission of fluids to provide said substantially reduced fluid flow rate;

wherein said diffuser contact surface is a portion of a pair of diffuser peripheral surfaces, which are sloped surfaces, each disposed at an angle to said mating surface, and which together form a junction which defines said diffuser contact surface;

wherein said diffuser contact surface defines a contact surface are which is smaller than a peripheral surface area of said at least one diffuser peripheral surface; and wherein a reduced frictional engagement, which is reduced in comparison to a full frictional engagement, is provided between said mating surface and said fluid flow diffuser by said diffuser contact surface defining a contact surface area which is smaller than a peripheral surface area of said at least one diffuser peripheral surface.

10. The downhole well tool of claim 9:

wherein said pair of diffuser peripheral surfaces have constant slopes which are oppositely inclined from said mating surface; and wherein said angles are constant at five degrees and defined between said mating surface and said mating pairs of peripheral surfaces which are oppositely inclined from said mating surface.

11. The downhole well tool of claim 5:

wherein said downhole well tool includes an expansion area, which provides a space for said fluid flow diffuser to deform into when said fluid flow diffuser presses into said mating surface harder than is necessary to choke said at least a portion of said selective transmission of fluids to provide said substantially reduced fluid flow rate, which is reduced substantially lower than a fluid flow rate which is not choked, to protect said seal from damage;

said downhole well tool further includes an interference fit between said fluid flow diffuser and said mating surface, wherein said interference fit, at least in part, energizes said fluid flow diffuser to press against said mating surface to choke said at least a portion of said selective transmission of fluid;

said fluid flow diffuser includes a diffuser contact surface which presses against said mating surface to choke said at least a portion of said selective transmission of fluids to provide said substantially reduced fluid flow rate;

wherein said diffuser contact surface is a portion of at least one diffuser peripheral surface and contacts said mating surface, and said diffuser contact surface defines a contact surface area which is smaller than a peripheral surface area of said at least one diffuser peripheral surface;

wherein a reduced frictional engagement, which is reduced in comparison to a full frictional engagement, is provided between said mating surface and said fluid flow diffuser by said diffuser contact surface defining a contact surface area which is smaller than a peripheral surface area of said at least one diffuser peripheral surface; and wherein said reduced frictional engagement is maintained by deformation of said fluid flow diffuser into said expansion area when said fluid flow diffuser presses into said mating surface harder than is necessary to choke said at least a portion of said selective transmission of fluids to provide said substantially reduced fluid flow rate.

12. The downhole well tool of claim 11, wherein said expansion area is formed as a notch cut into a surface of said fluid flow diffuser, said notch having a notch angle between opposing sides which is equal to forty degrees.

13. The downhole well tool of claim 5:

wherein said downhole well tool includes an expansion area, which provides a space for said fluid flow diffuser to deform into when said fluid flow diffuser presses into said mating surface harder than is necessary to choke said at least a portion of said selective transmission of fluids to provide said substantially reduced fluid flow rate, which is reduced substantially lower than a fluid flow rate which is not choked, to protect said sealing means from damage;

said downhole well tool further includes an interference fit between said fluid flow diffuser and said mating surface, wherein said interference fit, at least in part, energizes said fluid flow diffuser to press against said mating surface to choke said at least a portion of said selective transmission of fluid;

wherein said fluid flow diffuser includes a diffuser contact surface which presses against said mating surface to choke said at least a portion of said selective transmission of fluids to provide said substantially reduced fluid flow rate;

wherein a reduced frictional engagement, which is reduced in comparison to a full frictional engagement, is provided between said mating surface and said fluid flow diffuser by said diffuser contact surface defining a contact surface area which is smaller than a peripheral surface area of said at least one diffuser peripheral surface; and wherein said reduced frictional engagement is maintained by deformation of said fluid flow diffuser into said expansion area when said fluid flow diffuser presses into said mating surface harder than is necessary to choke said at least a portion of said selective transmission of fluids to provide said substantially reduced fluid flow rate.

14. The downhole well tool of claim 5, wherein said fluid flow diffuser is formed from thermoplastic.

15. A method for selective transmission of fluids through a wellbore conduit, said method comprising the steps of:

coupling a pair of ported members to be relatively movable, one with respect to the other, to selectively align a plurality of ports disposed through said ported members in a plurality of positions which include an open position and a closed position, and disposing said pair of ported members within said wellbore as a section of said wellbore conduit;

selectively isolating from fluid communication a first portion of said plurality of ports, which are disposed through one of said pair of ported members, from a second portion of said plurality of ports, which are disposed through an other of said pair of ported members, by positioning said one of said pair of ported members relative to said other of said pair of ported members with a sealing means disposed in a fluid communication path between said first and second portion of said plurality of ports, and thus positioning said pair of ported members in said closed position;

selectively communicating fluids between said first portion of said plurality of ports, which are disposed through said one of said pair of ported members, from said second portion said plurality of ports, which are disposed through said other of said pair of ported members, by positioning said one of said pair of ported members relative to said other of said pair of ported members to dispose said sealing means apart from a fluid flow path between said first and second portion of said plurality of ports, and thus positioning said pair of ported members in said open position; and protecting said sealing means from a damaging fluid flow impact of high pressure fluids by disposing a fluid flow diffuser between said pair of ported members, said fluid flow diffuser choking to a substantially reduced flow rate a fluid flow which passes through said fluid communication path when any of said ports are disposed adjacent to said sealing means.

16. The method of claim 15, wherein said sealing means is further protected by said fluid flow diffuser choking said fluid flow which passes through said fluid communication path when said fluid flow is flowing adjacent to said sealing means.

17. The method of claim 15, wherein said sealing means if further protected by said fluid flow diffuser choking said fluid flow which passes through said fluid communication path when said sealing means is between any of said plurality of ports.

18. The method of claim 15, wherein a reduced frictional engagement between said fluid flow diffuser and one of said two concentric ported members which moves relative to said fluid flow diffuser is provided by making said fluid flow diffuser with a shape having a raised diffuser contact point surface, which by contacting said one of said two ported members which moves relative to said fluid flow diffuser, chokes said fluid flow which passes through said fluid communication path.

19. The method of claim 15:

wherein said sealing means is protected from said damaging fluid flow impact of high pressure fluids passing through said fluid communication path by said fluid flow diffuser being urged into choking said fluid flow by an energization means, which at least in part includes an interference fit between said fluid flow diffuser and at least one of said pair of ported members, said method further comprising:

preventing a friction seizure that would prevent said pair of ported members from being relatively movable to selectively align said plurality of ports for said selective transmission of fluids by providing an expansion region for said fluid flow diffuser to expand into when said energization means increases beyond a maximum level at a temperature.

20. The method of claim 15, wherein said pair of ported members are longitudinally extending tubular members.

21. The method of claim 20, wherein said pair of ported members are relatively movable, with respect to the other, in a linear path along a longitudinal length of at least one of said pair of ported members for selectively aligning said plurality of ports.

22. A method for selective transmission of fluids through a wellbore conduit, said method comprising the steps of:

providing a first member having at least one port extending therethrough for passing said selective transmission of fluids;

disposing a second member about said first member for selectively moving with respect to said first member for selectively obstructing a fluid communication path which passes through said at least one port to prevent said selective transmission of fluids therethrough;

sealing a fluid flow path between said first and second members with a sealing means when said first member is selectively obstructing said at least one port; and choking a fluid flow along said flow path and across said sealing means to a substantially reduced flow rate, over that of a non-choked flow rate, with a fluid flow diffuser disposed between said first and second members to protect said sealing means from being damaged by said fluid flow.

23. A method for selective transmission of fluids through a wellbore conduit, said method comprising the steps of:

providing a first member having at least one port extending therethrough for passing said selective transmission of fluids;

disposing a second member about said first member for selectively moving with respect to said first member for selectively obstructing said at least one port to prevent said selective transmission of fluids therethrough;

sealing a fluid flow path between said first and second members with a sealing means when said first member is selectively obstructing said at least one port; and choking a fluid flow along said flow path and across said sealing means to a substantially reduced flow rate, over that of a non-choked flow rate, with a fluid flow diffuser disposed between said first and second members to protect said sealing means against damage from said fluid flow.

24. The method of claim 23, wherein said second member selectively obstructs said at least one port by being selectively moved to a position adjacent to said at least one port to block said fluid communication path which passes therethrough.

25. The method of claim 23, wherein said first and second members move relative to one another along a linear path by said second member reciprocating relative to said first member.

26. A downhole well tool securable to tubular members for forming a section of a fluid flow conduit within a well for a selective transmission of fluids between an interior and an exterior of said fluid flow conduit, said downhole well tool comprising:

a tubular housing having at least one fluid communication port extending laterally therethrough for said selective transmission of fluid, said tubular housing including a first threaded end for securing to a first tubular member;

a sleeve disposed about said tubular housing for selectively moving in a sliding engagement along said housing between an open and a closed positions to selectively obstruct said at least one fluid communication port for controlling said selective transmission of fluid;

a first and second seal means, which when said sleeve is selectively positioned in said closed position, are each disposed along said tubular housing on opposite sides of said at least one fluid communication port from the other, and sealingly engage between said tubular housing and said sleeve to seal against said selective transmission of fluid;

said first seal means sealingly engaging between said first tubular member and said sleeve; and a fluid flow diffuser for slidably engaging about a fluid flow path extending through said at least one fluid communication port and along said sleeve when said sleeve is selectively moved between said open and said closed positions, said fluid flow diffuser slidably engaging about said fluid flowpath to choke said selective transmission of fluid along said fluid flowpath to a substantially reduced flow rate across said first seal means.

27. The downhole well tool of claim 26, wherein said fluid flow diffuser is separated from said first seal means by a distance which is sufficiently large to assure that said fluid flow diffuser remains between said at least one fluid communication port and said first seal means during said selective transmission of fluid along said fluid flowpath.

28. The downhole well tool of claim 26, further comprising:

said fluid flow diffuser having a shape of a ring which includes a circumferentially extending expansion area for thermal expansion and a circumferentially extending point contact surface for slidably engaging about said fluid flowpath with a reduced frictional engagement.

29. A downhole well tool securable to tubular members for forming a section of a fluid flow conduit within a well for a selective transmission of wellbore fluid between an interior and an exterior of said fluid flow conduit, said downhole well tool comprising:

a tubular housing having at least one fluid communication port extending laterally therethrough for said selective transmission of wellbore fluid, said tubular housing including a first threaded end for securing to a first tubular member;

a sleeve disposed about said tubular housing for selectively moving in a sliding engagement along said housing between an open and a closed positions to selectively obstruct said at least one fluid communication port for controlling said selective transmission of wellbore fluid;

a first and second seal means, which when said sleeve is selectively positioned in said closed position, are each disposed between said tubular housing and said sleeve on opposite sides of said at least one fluid communication port from the other, and sealingly engage between said tubular housing and said sleeve to seal against said selective transmission of wellbore fluid; and a fluid flow diffuser for slidably engaging about a fluid flowpath extending through said at least one fluid communication port and between said tubular housing and said sleeve when said sleeve is selectively moved between said open and said closed positions, said fluid flow diffuser slidably engaging about said fluid flowpath to choke said selective transmission of fluid along said fluid flowpath to a substantially reduced flow rate across said first seal means when said first seal means is exposed to a fluid flow passing between said tubular housing and said sleeve.

30. The downhole well tool of claim 29, further comprising:

said fluid flow diffused having a shape of a ring which includes a circumferentially extending expansion area for thermal expansion and a circumferentially extending point contact surface for slidably engaging about said fluid flowpath with a reduced frictional engagement.

31. The downhole well tool of claim 29, further comprising:

said fluid flow diffuser disposed between said at least one fluid communication port and said first seal means to retain at said substantially reduced flow rate said fluid flow, which passes between said tubular housing and said sleeve, and which also passes about said first sealing means.

32. The downhole well tool of claim 3, wherein said sleeve is disposed within said housing.

33. The downhole well tool of claim 3, wherein said housing is a longitudinally extending tubular member having said at least one fluid communication port extending laterally therethrough.

34. The downhole well tool of claim 33, wherein said sleeve passes longitudinally along said housing in a linear path of travel when said sleeve is selectively moved between said open and said closed positions.

35. The downhole well tool of claim 33, wherein said housing is a tubular member having a cylindrical shape.

36. The downhole well tool of claim 35, wherein said sealing means includes a first and second seal means, said first and second seal means are disposed circumferentially about said housing, and said first seal means is disposed longitudinally across said at least one fluid communication port from said second seal means.

37. The downhole well tool of claim 3, wherein said fluid flow diffuser is separated from said at least a portion of said sealing means by a distance which is sufficiently large to assure that said fluid flow diffuser remains between said at least one fluid communication port and said at least one fluid flow port while said at least a portion of said sealing means is therebetween.

38. The downhole well tool of claim 3, wherein said fluid flow diffuser engages between said housing and said sleeve with a reduced frictional engagement, and said reduced frictional engagement is retained as said downhole tool is exposed to a plurality of temperatures within said well.

39. The downhole well tool of claim 5, wherein said moveable valve member is selectively movable between said open and closed positions by moving linearly with respect to said stationery member, so that said movable valve member reciprocates with respect to said stationery member.

40. The downhole well tool of claim 39, wherein said stationery member is a longitudinally extending tubular member having said at least one fluid communication port extending laterally therethrough; and wherein said movable valve member moves linearly with respect to said stationery member by moving longitudinally along said stationery member.

41. The downhole well tool of claim 5, wherein said fluid flow diffuser is separated from said sealing means by a distance which is sufficiently large to assure that said fluid flow diffuser remains between said at least one fluid communication port and said sealing means for as long as said sealing means is disposed between said housing and said sleeve along a fluid flow path which passes fluids therebetween.

42. The downhole well tool of claim 5, wherein said fluid flow diffuser engages between said housing and said sleeve with a reduced frictional engagement, and said reduced frictional engagement is retained as said downhole tool is exposed to a plurality of temperatures within said well.

43. A fluid flow diffuser for use in a downhole well tool to protect a sealing means from being damaged by a high pressure wellbore fluid flowing across said sealing means, said fluid flow diffuser comprising:

a diffuser body, for inserting and securing within said downhole well tool along a fluid flow path within which said sealing means is at least partially disposed; and at least one diffuser contact surface which extends towards an adjacent surface of said downhole well tool for throttling said high pressure wellbore fluid which flows therebetween and across said sealing means.

44. The fluid flow diffuser of claim 43, wherein said diffuser contact surface is urged to press against said adjacent surface of said downhole well tool with a reduced frictional engagement.

45. A fluid flow diffuser for use in a downhole well tool to protect a sealing means from being damaged by a high pressure wellbore fluid flowing across said sealing means, said fluid flow diffuser comprising:

a diffuser body, for inserting and securing within said downhole well tool along a fluid flow path within which said sealing means is at least partially disposed;

a diffuser contact surface which presses against an adjacent surface of said downhole well tool to throttle said high pressure wellbore fluid flowing along said flow path and across said sealing means; and an energization means for urging said diffuser contact surface to press against said adjacent surface of said downhole well tool.

46. The fluid flow diffuser of claim 45, wherein said diffuser contact surface presses into said adjacent surface of said downhole well tool with a reduced frictional engagement provided by having at least one surface extending from said diffuser body and towards said adjacent surface of said downhole well tool at a slope with respect to said adjacent surface of said downhole well tool.

47. The fluid flow diffuser of claim 46, further comprising:

a notched expansion area extending about said diffuser body to retain said reduced frictional engagement by providing said notched expression area for said diffuser to expand into when exposed to a plurality of wellbore temperatures.

48. The fluid flow diffuser of claim 47, wherein said diffuser is formed from a thermoplastic material.

* * * * *